US006113526A

United States Patent [19]

Lotto

[11] Patent Number: 6,113,526

[45] Date of Patent: Sep. 5, 2000

[54] BAG-FOLDING APPARATUS

[75] Inventor: Ronald L. Lotto, Cecil, Wis.

[73] Assignee: Hudson-Sharp Machine Co., Green Bay, Wis.

[21] Appl. No.: 08/770,759

[22] Filed: Dec. 19, 1996

[51] Int. Cl.[7] ..... B31F 1/30

[52] U.S. Cl. ..... 493/441; 493/234; 493/231; 493/243; 493/257

[58] Field of Search ..... 493/234, 441, 493/231, 243, 257, 406

[56] References Cited

U.S. PATENT DOCUMENTS

| | | | |
|---|---|---|---|
| 4,498,894 | 2/1985 | Kuckhermann | 493/234 |
| 4,614,512 | 9/1986 | Capdeboscq | 493/441 |
| 5,388,746 | 2/1995 | Hatchell et al. | 493/234 |
| 5,399,228 | 3/1995 | Schroeder et al. | 198/780 |

*Primary Examiner*—Eugene Kim
*Attorney, Agent, or Firm*—Rockey, Milnamow & Katz, Ltd.

[57] ABSTRACT

A folding apparatus of a bag-making machine includes a plurality of folding mechanisms each having a pair of nip rollers which receive a sheet or bag from an associated carrier structure, to thereby sequentially form transverse folds in each sheet or bag. In order to abate lamination-like adhesion of relatively thin, light gauge film materials to the belts and other surfaces of the folding apparatus, the belts and/or guide rollers of the apparatus are preferably provided with grooved sheet-contacting surfaces. The apparatus is additionally configured to abate wrinkling or buckling of a leading edge portion of each sheet or bag which can occur attendant to its reversal in direction of movement as it is directed between the nip rollers of each folding mechanism. High-speed operation is facilitated while avoiding improperly folded bags, or equipment jamming.

13 Claims, 6 Drawing Sheets

BAG-FOLDING APPARATUS

TECHNICAL FIELD

The present invention relates generally to bag-making machines, and more particularly to a folding apparatus which can be incorporated in a bag-making separator/folder, wherein the folding apparatus is particularly configured to facilitate handling of relatively thin, light gauge film materials.

BACKGROUND OF THE INVENTION

Plastic bags of various types are in widespread use throughout the world. Such bags can be economically manufactured in large quantities from extruded plastic films, and a variety of machines have been developed for automating the bag-making process. Advancements in such machines facilitate high speed, economical manufacture of such bags.

Plastic bags are typically formed from a continuous plastic web that can be in the form of a flattened continuous tube or a continuous folded sheet. By forming bottom welds, in the case of a tubular web, and side welds, in the case of a folded web, individual bags are defined. Typically, a perforation adjacent the bottom or side weld allows separation of the individual bags. Until separation, the bags remain strung together in a continuous ribbon.

For eventual use of the bags, it is frequently desirable that the bags be separated from one another for packaging. At the same time, relatively large bags must ordinarily be folded in order to economically and conveniently package the bags. To this end, integrated machinery for effecting separation and folding of such plastic bags has been developed. U.S. Pat. No. 5,388,746, hereby incorporated by reference, illustrates one such separator/folder machine which has proven to greatly facilitate high-speed manufacture and packaging of bags.

In an apparatus which is disclosed in the above-referenced patent, individual bags are separated from each other, and subjected to a sequential folding process. In particular, an intermediate portion of each bag is directed between a pair of cooperating nip rollers, and associated flat belts, which effect formation of a fold in the bag across its width. By successive formation of such folds (for example, three), the length of the bag can be reduced to one-eighth its original length. In conjunction with longitudinal folding of the bag, typically effected prior to transverse folding, relatively large bags can be conveniently packaged for eventual use by consumers and other end users.

Use of relatively lightweight, light gauge plastic film materials for bag manufacture is desirable to facilitate economical manufacture. However, experience has shown that use of an apparatus such as disclosed in the above-referenced patent with relatively light gauge plastic film materials, at the high speeds at which such an apparatus is capable of operating, can result in undesirable wrinkling, folding, buckling, or like undesired variations from the desired folding sequence. Such undesired effects can result from the manner in which portions of the bags must be subjected to a sudden change in direction of movement attendant to the folding sequence. Additionally, the relatively lightweight bag material can exhibit a lamination-like adhesion to the relatively wide, flat belt and associated rollers which are employed in the folding mechanisms of the apparatus disclosed in the above-referenced patent.

Accordingly, the present invention contemplates specific features which can be incorporated in a bag-making apparatus of the above type for facilitating high-speed handling and folding of plastic bags, and particularly those made from relatively lightweight, light gauge plastic film materials.

SUMMARY OF THE INVENTION

An apparatus for folding individual sheets of material in the form of bags configured in accordance with the present invention includes features which control movement of the bag-making material during the necessary reversal in its direction of movement during folding. Additionally, belts and specific guide rollers of the apparatus have been configured to abate the lamination-like adhesion which can result attendant to handling of relatively lightweight, light gauge plastic film materials. Not only are the sheets of bag-making material folded in the intended manner, without undesired wrinkling or folding, jamming or other disruptions in the bag-making process are desirably avoided.

In accordance with the present invention, an apparatus for folding individual sheets of material, such as individual bags, is illustrated in the form of an integrated separator/folder. The folding apparatus of the machine is configured to receive the sheets of bag-making material from an associated infeed, which in the illustrated embodiment, comprises the separator of the integrated machine.

The folding apparatus includes at least one carrier along which each individual sheet is carried as it is received from the associated infeed. At least one pair of nip rollers is positioned in respective operative association with each of the carriers of the apparatus, with at least one pair of opposed, substantially flat belts respectively trained about the pair of nip rollers. In the illustrated embodiment, the apparatus includes a plurality of folding mechanisms, each including a carrier, a pair of nip rollers, and a pair of the flat belts, with the plurality of folding mechanisms arranged to effect sequential, transverse folding of sheets of bag-making material successively received from the associated infeed, and directed through the folding apparatus. In the preferred embodiment, comprising a plurality of sequentially arranged folding mechanisms, a common upper belt is employed for each of the folding mechanisms of the apparatus.

In order to effect the desired folding in each of the pair of nip rollers of each folding mechanism, an arrangement is provided for directing an intermediate portion of each of the sheets of material from a respective one of the carriers between a respective pair of the nip rollers and the associated flat belts. In the illustrated embodiment, an air knife is intermittently operated to effect this direction or tucking of a sheet of bag-making material between the nip rollers and the associated belts.

In order to abate lamination-like adhesion of the bag-making material to the belts of the folding apparatus, at least one, and preferably both, of the belts are provided with an arrangement for abating such adhesion. In the preferred form, each of the belts is provided with a plurality of longitudinally extending grooves which are defined by a sheet-contacting surface thereof. The provision of these grooves has been found to desirably abate adhesion of relatively lightweight film material to the belts of the plural folding mechanisms.

It has further been found to preferably provide the common upper belt of the folding apparatus with a plurality of holes extending therethrough. Again, this desirably acts to abate the adhesion of relatively lightweight film materials to the belt. In the preferred form, at least some of the holes extending through the belt extend from the bottom of the longitudinally extending grooves defined by the sheet-contacting surface of the belt. In a particularly preferred form, the belt is provided with a plurality of transversely extending drive teeth on the surface opposite the sheet-contacting surface of the belt. When the belt has this toothed configuration (sometimes referred to as a "timing belt"), it is preferred that the holes which extend through the belt are provided intermediate the transversely-extending drive teeth. As a consequence, as the belt is moved past the associated nip roller, the teeth of the nip roller cooperate with the teeth of the belt to provide a "gear pump-like" action which acts to move air through the holes in the belt, thereby further acting to abate adhesion of lightweight film materials to the belt.

As noted, a portion of each sheet of material is subjected to a reversal of direction in movement as the intermediate portion of the sheet is directed between the nip rollers and associated belts of each folding mechanism. At increased forming speeds, the highly flexible nature of relatively lightweight film materials can exhibit undesired folding, wrinkling, buckling, or the like at the edge portion of the sheet subjected to this rapid reversal in direction of movement. Accordingly, the present apparatus includes at least one guide positioned in operative association with a respective one of the carriers of each folding mechanism. The guide acts to prevent folding of a leading edge portion of each sheet as it is directed from the carrier and is folded between the respective pair of nip rollers and pair of flat belts. In one embodiment, a perforated guide plate is positioned in closely spaced relationship to the associated carrier to provide this desired guiding function, which acts to prevent folding, wrinkling, or the like at the leading edge portion of the sheet of material. In an alternate embodiment, the guide is provided in the form of a guide conveyor having a sheet-contacting surface positioned in closely spaced relationship to the associated carrier. The sheet-contacting surface of the conveyor is driven in a direction opposite to the direction of movement of each sheet as it is directed between the respective pair of nip rollers and flat belts. The guide conveyor thus acts to desirably control and abate wrinkling or the like of the leading edge portion of the sheet.

In the preferred embodiment of the apparatus, including a plurality of sequentially arranged folding mechanisms, the apparatus includes a guide roller positioned between upstream and downstream ones of the folding mechanisms about which the common upper belt of the mechanisms is trained. Again, it has been found to be desirable to avoid adhesion of relatively lightweight film materials to this guide roller as each sheet of material is carried about the roller together with the common upper belt. To this end, the guide roller preferably defines a plurality of circumferentially extending grooves at the periphery thereof, thus abating adhesion of the bag-making material to the guide roller as the sheet is carried thereabout on a sheet-contacting surface of the common upper belt.

Experience has also shown that as the sheet of material moves from the upstream one of the folding mechanisms to the guide roller positioned between the folding mechanisms, the sheet can undesirably separate from the sheet-contacting surface of the upper belt of the apparatus. To maintain the sheet in the desired conformance with the upper belt, the present apparatus preferably includes a vacuum-applying arrangement positioned immediately upstream of the guide roller. This arrangement applies vacuum through the holes in the upper belt so that each sheet is held against the sheet-contacting surface of the belt as the belt and sheet are guided about the guide roller.

Other features and advantages of the present invention will become apparent from the following detailed description, the accompanying drawings, and the appended claims.

DETAILED DESCRIPTION

Figure 1:
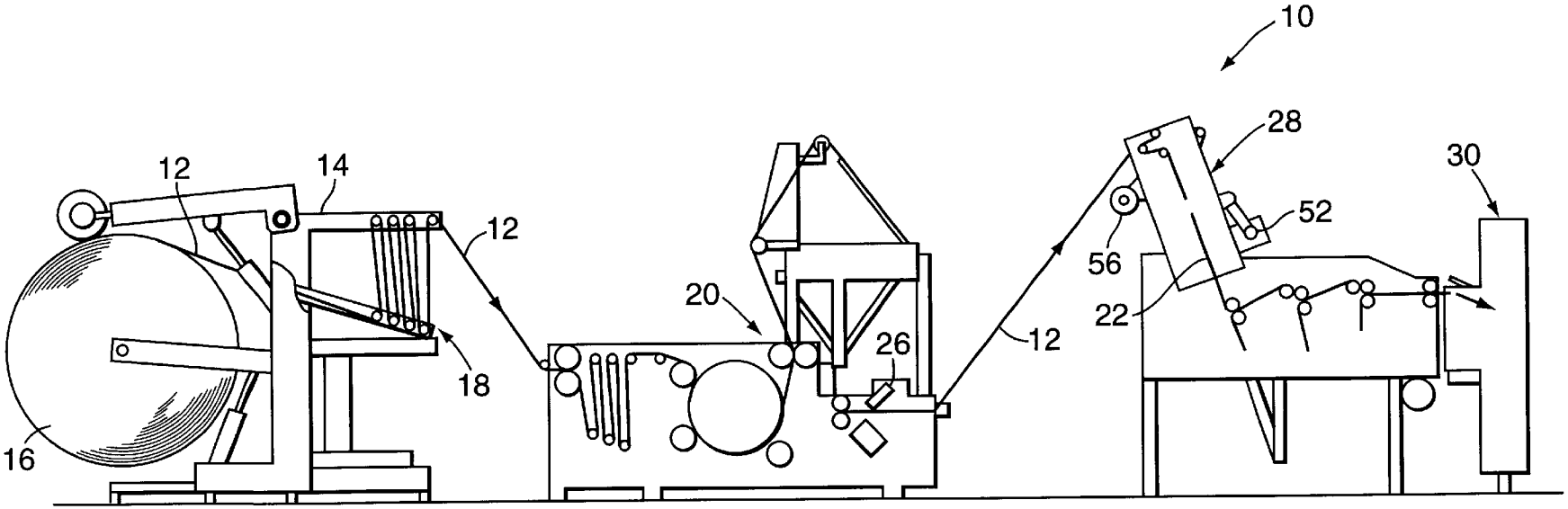
FIG. 1 is a diagrammatic side elevational view of a bag-making production line including a separator/folder having a folding apparatus embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring to FIG. 1, a bag-making production line 10 is illustrated. In the illustrated embodiment, the production line functions to convert a continuous, tubular plastic web 12 into stacks of individual, folded plastic bags. The production line includes a driven unwind machine 14 of known construction that contains a supply roll 16 of the continuous, tubular plastic web. The unwind machine unwinds the web from the roll and discharges it through a dancer mechanism 18 that functions to keep substantially constant tension on the discharged web 12.

From the unwind machine, the web is fed into a rotary bag machine 20 of known construction. The rotary bag machine forms a plurality of regularly spaced, transverse bottom welds across the web. Individual bags are defined between the spaced bottom welds. Following the formation of the bottom welds, the web passes through a plurality of folding boards that fold the side edges of the web inwardly along fold lines extending parallel to the longitudinal axis of the web. The width of the web as it leaves the bag-making machine 20 is thus reduced considerably. A perforating mechanism or knife adjacent the output of the bag-making machine 20 perforates the web 12 immediately downstream of each bottom weld to permit separation of individual bags (22). The bags remain connected in a continuous ribbon or web 12, however, as they leave the bag-making machine 20.

From the bag-making machine 20, the welded, longitudinally folded and perforated web 12 is fed to a separator/folder machine 28, including a folding mechanism embodying the principles of the present invention. The separator/folder 28 functions to separate the continuous plastic web 12 along the perforations into individual bags or sheets and then to fold the individual bags along predetermined fold lines extending across the width of each bag 22. From the separator/folder 28, the folded bags 22 are delivered to a bag stacker and indexing conveyor 30. The bag stacker and indexing conveyor 30 stack the folded bags in predetermined numbers and transfer the stacks downstream for further processing.

Figure 2:
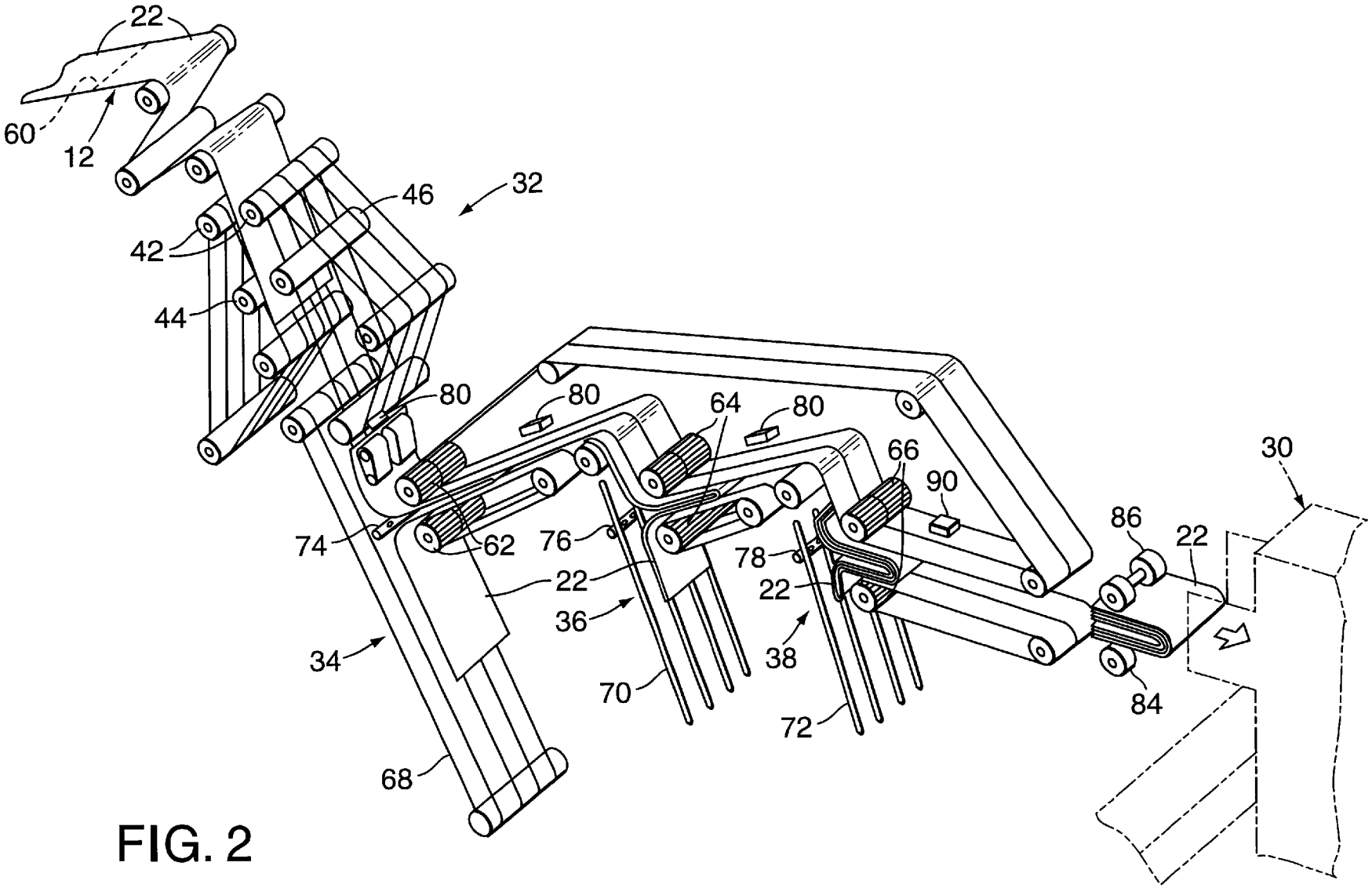
FIG. 2 is a diagrammatic view of the separating and folding mechanisms of the machine shown in FIG. 1.

Referring to FIG. 2, the separator/folder 28 includes, in combination, a separator mechanism 32 for separating the individual bags, and a folding apparatus embodying the principles of the present invention, including a plurality of sequentially arranged fold stations or folding mechanisms 34, 36, and 38 for folding the bags 22 across predetermined fold lines, with the apparatus including a conveyor mechanism for conveying the bags 22 between the separator mechanism 32 and the folding mechanisms 34, 36 and 38.

Figure 3:
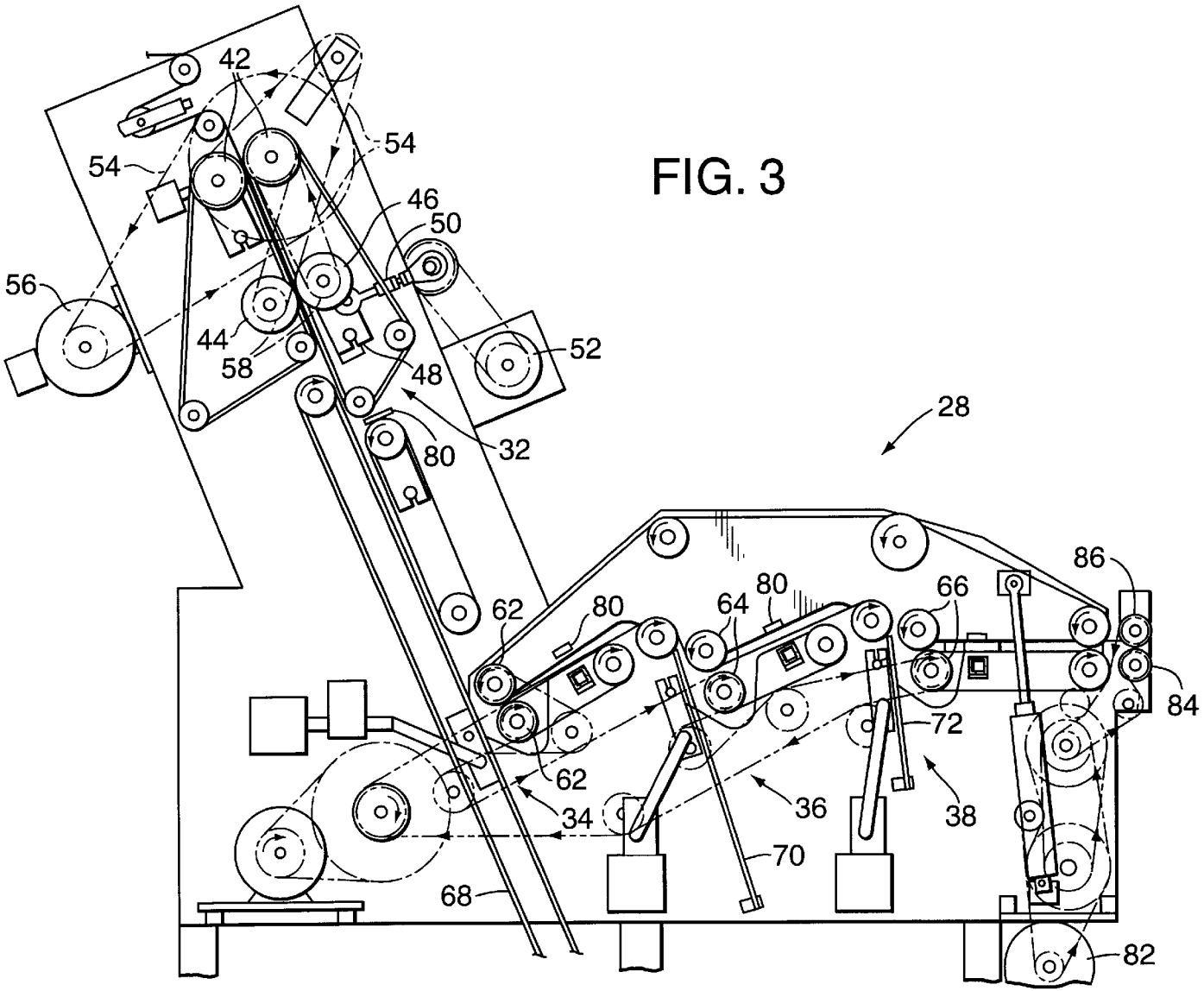
FIG. 3 is a side elevational view of the separator/folder shown in FIG. 1.

Referring to FIGS. 2 and 3, the separator mechanism 32 includes an infeed mechanism operable to advance the plastic web at a predetermined speed. As can be seen in FIGS. 2 and 3, a "rope belt" transport system is used wherein ropes run in grooves and various rollers of the system as is well-known in the art. The grooves in the roller accommodate the ropes at a depth such that the level of the rope in the grooves is at or slightly lower than the normal surface of the rollers. As is apparent from FIG. 3, the fixed lower roller 44 and the other separation roller or upper nip roller 46 are provided with grooves to accommodate the ropes such that the normal surfaces of the separation rollers can come together as necessary to "grip" the top and obverse sides of the web 12.

In the illustrated embodiment, the infeed mechanism comprises a pair of nip rollers 42. Downstream of the nip rollers 42, the separator mechanism 32 further includes an additional pair of nip or separation rollers 44, 46. The separation rollers 44, 46 operate at a speed higher than the infeed nip rollers 42 and are mounted for reciprocating movement into and out of engagement with each other. In particular, the upper nip roller 46 is mounted on a bracket 48 that, in turn, pivots substantially up and down relative to the fixed lower roller 44. The pivoting bracket 48, in turn, is coupled through an eccentric linkage 50 to a drive motor 52 so that operation of the motor 52 results in reciprocating movement of the upper roller 46 into and out of engagement with the lower roller 44.

The lower roller 44 and upper roller 46 are coupled through a plurality of drive belts 54 to an infeed drive motor 56 that operates the infeed rollers 42. By the relatively reduced size of the drive pulleys 58 coupled to the lower and upper nip or separation rollers 44, the nip rollers 44, 46 operate faster than the infeed rollers 42. In one embodiment, the nip or separation rollers 44, 46 are operated at a speed 25% greater than the speed of the infeed rollers. In addition, the separation rollers 44, 46 are mounted so that the maximum gap between the upper and lower separation rollers is approximately one-quarter inch. When the infeed and separation rollers contact the web 12 simultaneously, the speed differential between the sets of the rollers, that is, the speed differential between the infeed roller set 42, 42, and the set of nip or separation rollers 44, 46, creates a longitudinally directed tension in the web 12. If a line of perforation 60 making the juncture between adjacent bags 22 is present between the infeed rollers 42, 42 and nip rollers 44, 46, the tension thus developed is sufficient to tear the web along the perforation 60 and thus separate the individual bags 22, with the bags thus taking the form of sheets of bag-making material.

To ensure proper separation of the bags 22, motor 52 for operating the eccentric linkage 50 is preferably a servo motor that operates in accordance with web position information derived from the upstream bag-making machine 20.

Figure 4:
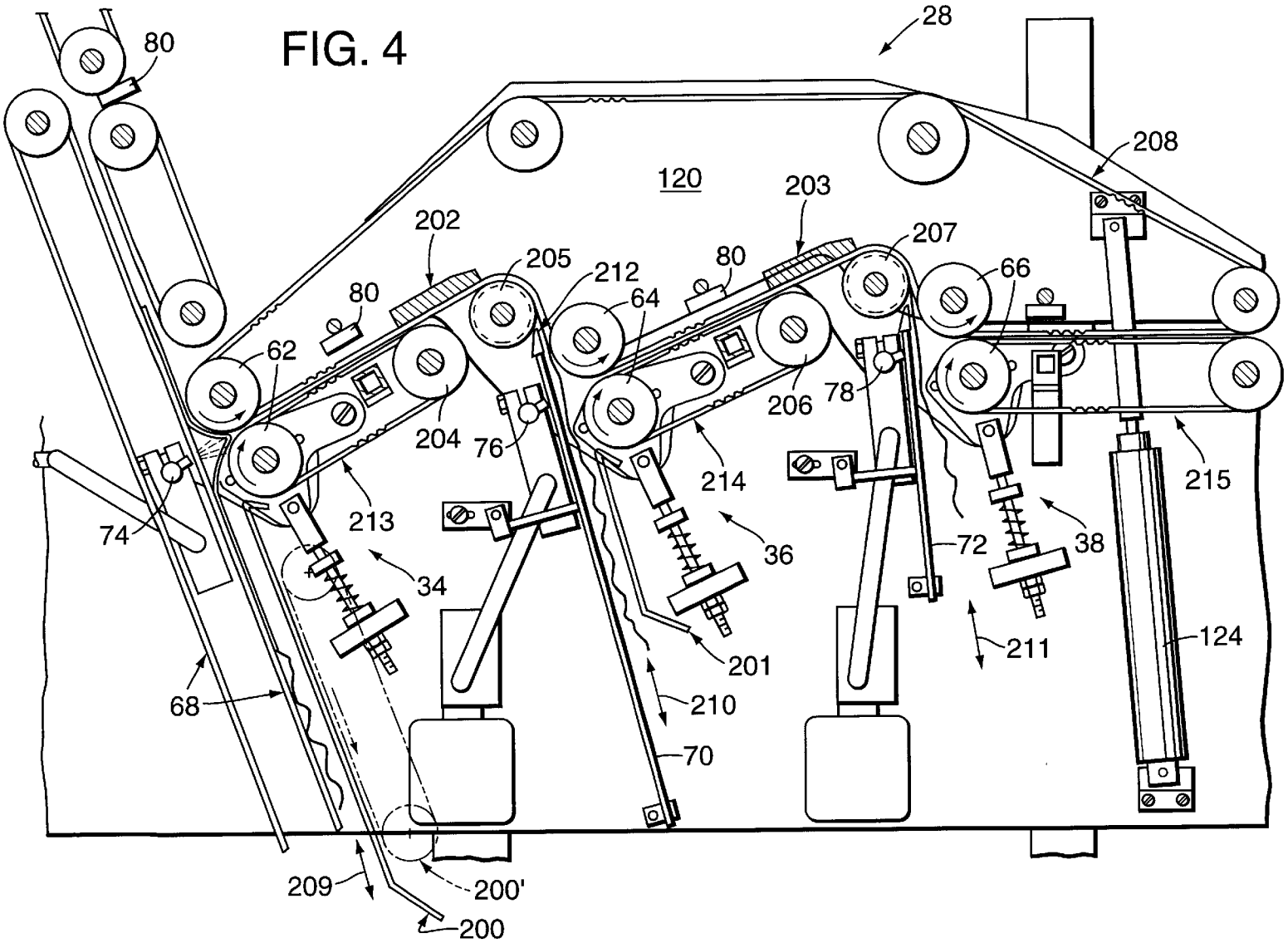
FIG. 4 is an enlarged, fragmentary side elevational view of the folding apparatus, embodying the principles of the present invention, of the separator/folder shown in FIG. 3.

With reference to FIGS. 2, 3, and 4, the separator/folder mechanism 28 includes a folding apparatus embodying the principles of the present invention, including a plurality, i.e., three, separate fold stations or mechanisms 34, 36 and 38. Each of the folding mechanisms is capable of folding an individual bag 22 (alternately referred to a sheet) once along a foldline extending across the width of the bag perpendicular to the side edges thereof. As illustrated, each folding mechanism includes a pair of nip rollers 62, 64 and 66, respectively, that rotate in the direction shown by the arrows in FIG. 4. A carrier conveyor 68 of the first folding mechanism 34 receives the bags in the form of sheets from the upstream separator 32, with the separator thus providing the infeed for the plural folding mechanisms. In contrast, the downstream ones of the folding mechanisms 36 and 38 respectively include carrier rods 70, 72 upon which each individual sheet or bag is received for direction from the carrier rods into the respective pair of nip rollers.

In order to direct each sheet or bag through the nip rollers of the folding mechanism, each folding mechanism includes an air jet or air knife, respectively designated 74, 76 and 78. The air knives are respectively positioned in operative association with the carrier conveyor 68, and the carrier rods 70, 72 of the folding mechanisms. When the air jet or knife of each folding mechanism is actuated, the sheet carried on the associated carrier (i.e., carrier conveyor 68, or carrier rods 70, 72) is tucked between the associated rollers 62, 64 and 66. A fiber optic pick-up scanner 80 mounted adjacent each carrier 68, 70, 72 senses the trailing edge of each sheet or bag on carrier 68 and the leading edge of each sheet or bag on carrier rods 70, 72 as it travels past. The pick-up scanner actuates a counter that times actuation of the air jets 74, 76, 78 so that actuation occurs when an intermediate portion of the sheet (i.e., the middle of the bag), is opposite the associated air jet or knife. This causes the bag or sheet to be folded in half as it travels through the associated rollers, with the sequence of folding effected as each sheet or bag sequentially moves through the folding mechanisms.

In the preferred form, a slow-down mechanism is provided including a motor 82 and a pair of slow-down wheels 84, 86 coupled to the motor 82. The slow-down wheels 84, 86 can be operated at either an adjustable constant speed, or intermittently operated at fast/slow speeds by way of servo control of motor 82.

With particular reference to FIG. 4, specific features of the present folding apparatus are configured to facilitate handling of relatively lightweight, light gauge plastic sheet material which typically is extremely flexible. As noted above, each sheet or bag is initially received upon carrier conveyor 68 from the associated infeed provided by separator 32. Experience has shown that as the associated air knife or jet 74 discharges a blast of air to direct the bag between the nip rollers 62, the leading edge portion of the sheet is subjected to a rapid reversal in direction of movement. At high speeds, this creates a "whip-cracking-like" effect. The leading edge portion can jump violently up or down causing it to buckle at various points near the leading edge. The film is undesirably pulled between the roller 62 in this buckled or folded condition, thus undesirably resulting in permanent wrinkles in this portion of the folded bag or sheet.

In the illustrated embodiment of the present folding apparatus, at least one pair, and preferably two pairs of substantially flat belts are provided which are trained about the rollers 62, 64, and 66 of the plural folding mechanisms. In a presently preferred form, a common upper belt 208 (or a pair of belts arranged in parallel) is provided which extends sequentially through the plural folding mechanisms. In turn, each of the folding mechanisms includes two adjacent substantially flat lower belts, respectively designated 213, 214, and 215 (only one of the preferred two flat lower belts is shown for each of the folding mechanisms 32, 36, 38).

In order to control the undesired wrinkling or buckling of the leading edge portion of each sheet, the present folding apparatus includes a guide arrangement positioned in closely spaced relationship to the carrier conveyor 68 of folding mechanism 34, and the carrier rods 70 of folding mechanism 36. The provision of guide structures at these regions has been found to desirably abate the buckling or wrinkling problem of the leading edge portion of each sheet or bag, which can occur at the areas designated by double-headed arrows 209, 210. While not illustrated, a like effect can occur at area 211, in association with nip rollers 66 of third folding mechanism 38, and it is within the purview of the present invention to provide a like guide structure in operative association with carrier rods 72.

In accordance with the illustrated embodiment, a perforated guide plate or screen 200 is provided in closely spaced relationship to the conveyor guide 68 in order to prevent folding or buckling of the leading edge portion of each sheet as it is directed from the carrier conveyor and is folded between the respective pair of nip rollers 62 and the associated pair of flat belts 213, 208. Similarly, a perforated guide plate or screen 201 can be positioned in operative association with carrier rods 70, again acting to prevent folding or buckling of a leading edge portion of the sheet or bag as it is directed by air knife 76 between nip rollers 64.

In an alternate arrangement illustrated in phantom line at 200', a guide arrangement can be provided in the form of a guide conveyor having a sheet-contacting surface positioned in closely spaced relationship to the associated carrier conveyor 68. The sheet-contacting surface of guide conveyor 200' is driven in a direction opposite to the direction of movement of each sheet or bag as it is directed by air knife 74 between the respective pair of nip rollers 62 and the pair of flat belts 208, 213. The conveyor 200' can be provided in the form of one or more driven flat belts, with use at the upstream most one of the folding mechanisms 34 being particularly desirable since the leading edge portion of the sheet subjected to the above-described "whip" effect is much longer at this portion of the folding apparatus (the longer the sheet or bag, the more pronounced the "whip" effect).

It is contemplated that the belts of conveyor 200' be run at the same speed as the belts of the carrier conveyor 68. The gap between the carrier conveyor 68 and the guide conveyor 200' can be smaller than the gap which is provided between carrier conveyor 68 and perforated plate 200, thereby preventing the bags from "stumbling" or otherwise being disrupted in movement as they move past the nip roller 64. The belts of the conveyor 200' desirably "iron out" any wrinkles in the bag as its leading edge portion moves downwardly. When the air knife 74 is actuated to direct the intermediate portion of the bag into the nip rollers 62, the driven flat belts of the conveyor 200' desirably act to contain the "whip" effect of the leading edge portion. As will be appreciated, the direction of movement of the sheet-contacting surface of the conveyor 200' is opposite to the direction of movement of the bag or sheet as it is drawn between the nip rollers 62. This will desirably result in an additional "ironing out" of any wrinkles or buckles in the leading edge portion of the sheet or bag.

As noted, an apparatus embodying the principles of the present invention typically employs two pairs of parallel belts in the conveyors of the apparatus, sometimes referred to as "timing belts" in view of the internally toothed configuration of the belts, that is, the provision of transversely extending teeth. The belts of the conveyor convey the sheet or film material from one folding mechanism to another, and also create the fold nip points at mating pairs of the belt drive rolls. In a current apparatus, 10-inch wide belts are employed, with approximately a one-half inch gap between the belts down the center of the folding apparatus. This allows scanning of the bags or sheets of material through the sets of belts to detect the movement of the material through the belts. The scanner output is then used to start timing functions for air valve operation for the air jets or knives 74, 76, and 78.

Experience has shown that when light gauge or extremely flexible (i.e., limp) film material is run through the folding apparatus, the air between the folder belts and the film is squeezed out. This tends to create a lamination-like adhesion between the sheet material and the belts. As a consequence, the film can tend to follow the upper belt 208 rather than releasing from the belt prior to direction of the sheet of material through the next folding mechanism. Undesirably, the leading edge portion of the sheet or bag then travels directly into the fold nip of the folding mechanism. The leading edge may only partially release from the upper belt 208, with the remainder of the sheet or bag following the belt through the fold nip. This undesirably results in a wad of wrinkled-up film going into the fold nip, which results in an incompletely folded bag discharging from the apparatus, thus resulting in undesirable jamming in the stacking area downstream of the apparatus. As will be appreciated, this problem of lamination-like adhesion is not as pronounced with relatively thicker gauge material, or bags or sheets which have previously been longitudinally folded. Such sheets tend to "peel off" the belt and continue in a straight line rather than follow the belts around a roller.

Figure 5:
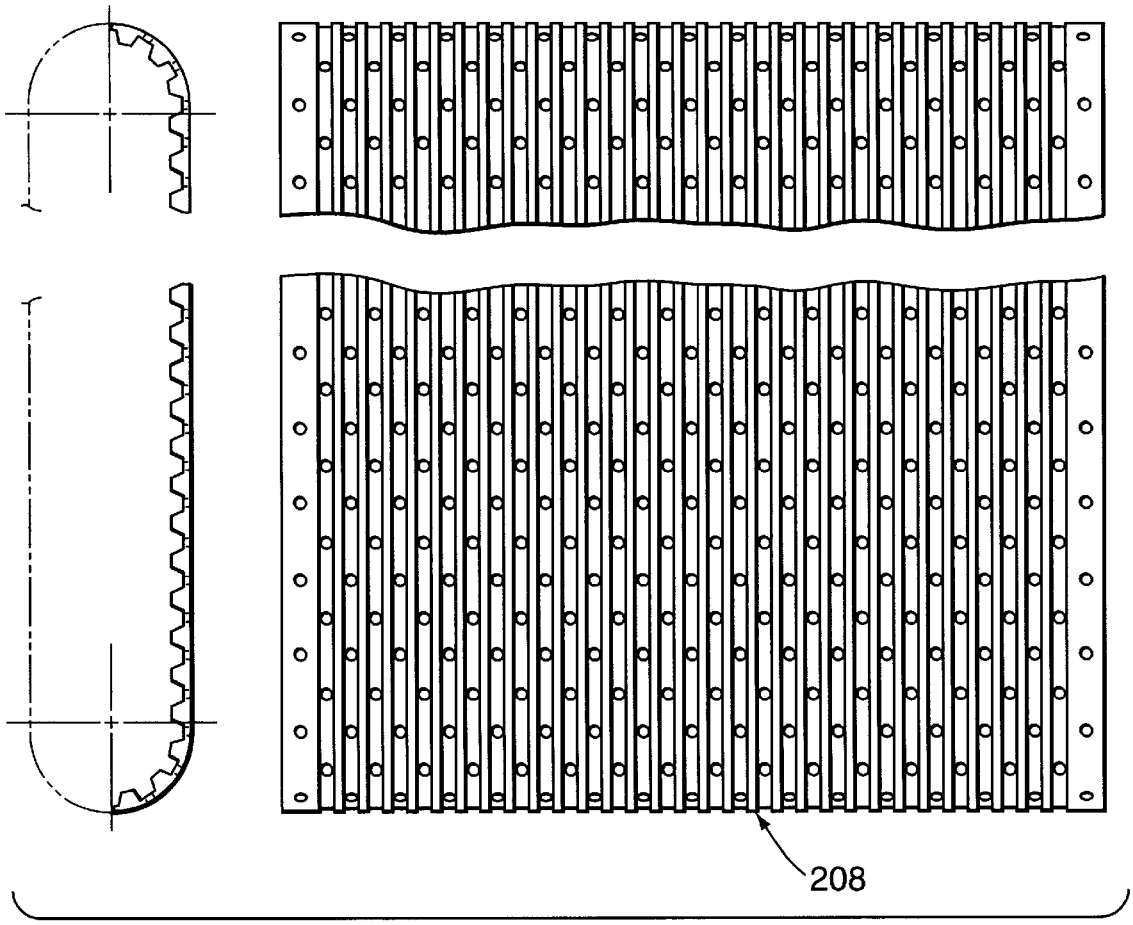
FIG. 5 is a view of a conveyor belt, employed in the present folding apparatus, embodying the principles of the present invention.
Figure 7:
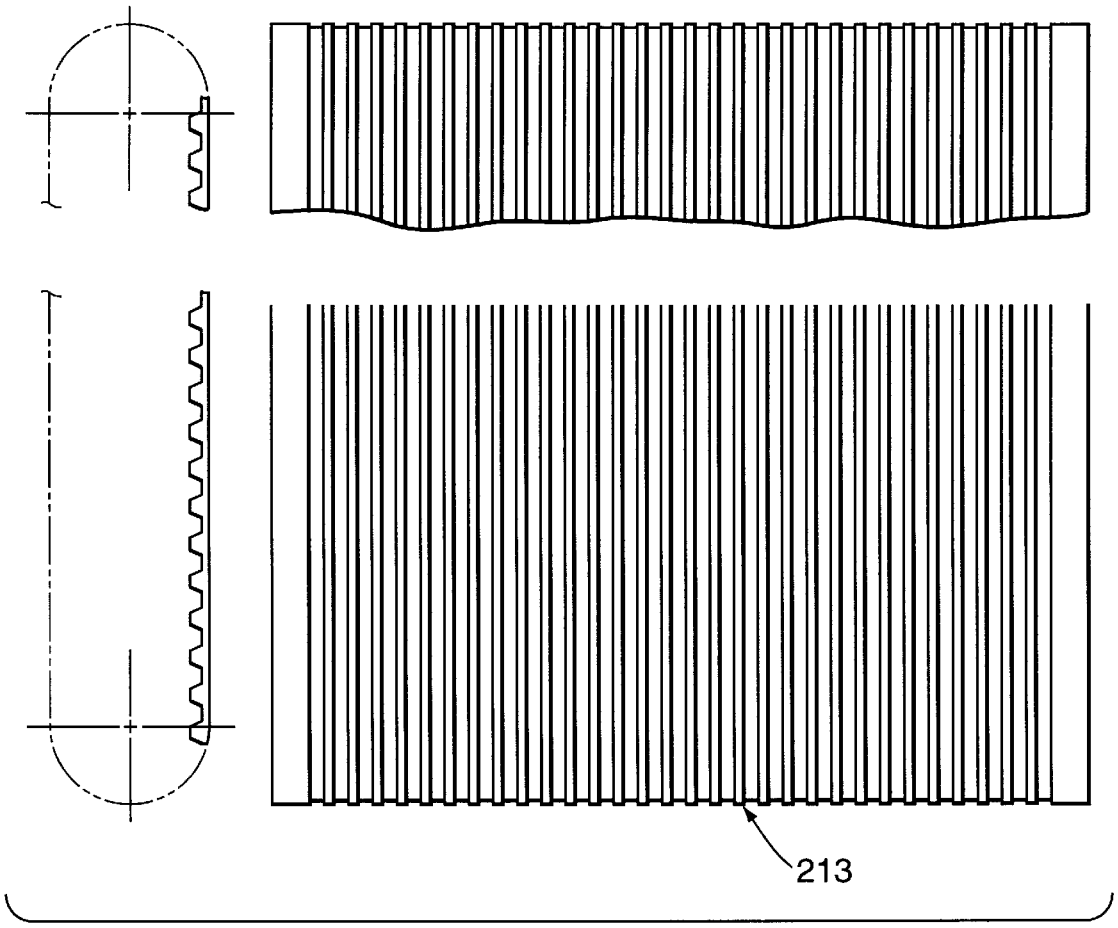
FIG. 7 is an illustration of another conveyor belt of the present folding apparatus.

In order to abate such lamination-like adhesion, the present invention includes belts configured to define longitudinally extending grooves in their sheet-contacting surfaces. FIG. 5 illustrates the upper belt 208 having a plurality of longitudinally extending grooves formed in the sheet-contacting surface thereof. Similarly, FIG. 7 illustrates longitudinally extending grooves defined by the sheet-contacting surface of one of the belts 213 of folding mechanism 34 (with the understanding that belts 214, 215 of mechanisms 36, 38 can be likewise configured). In this regard, it is preferred that the groove pattern of the upper and lower belts differ to avoid interaction between the upper and lower belt grooves at points where the belts contact each other. For example, lower belts 213, 214 may be provided with a finer pattern than the grooved pattern of top belt 208.

In order to further abate the lamination-like adhesion of relatively thin sheets of bag-making material to the upper belt 208, it is presently preferred that the upper belt 208 be provided with a plurality of holes extending therethrough. These holes are preferably drilled or punched through the belt so that they extend from the bottom or root of the longitudinally extending grooves of the belt.

Figure 6:
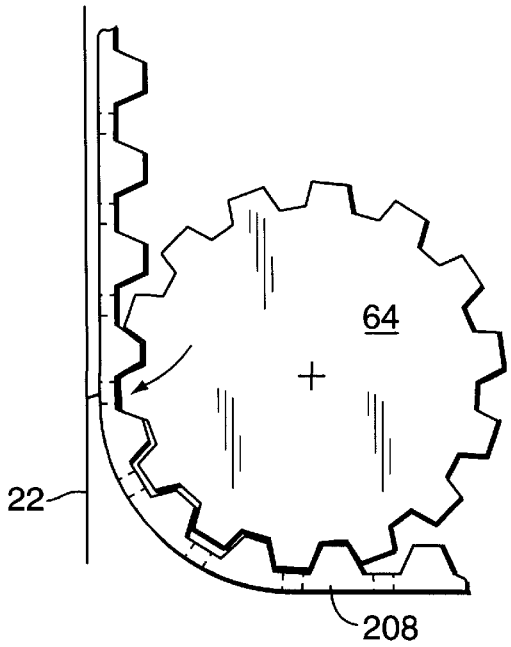
FIG. 6 is a diagrammatic view illustrating cooperation of the belt shown in FIG. 5 with an associated toothed roller.

In a most preferred form, the holes which extend through the belt 208 are positioned so that at least some, and preferably all, of the holes extend through the belt between the transversely extending drive teeth on the interior of the belt. By this arrangement, a "gear pump"-like pumping action is effected, with air being driven through the holes in the belt as the belt moves over the toothed rollers 62, 64, 66 (see FIG. 6). This air pump-like action is particularly desirable in connection with the roller 64 of folding mechanism 36, since the lamination-like adhesion of the sheet or bag to the upper belt 208 can be problematic at this location. By this action, the sheet or bag is subjected to air forced through the holes in the belt directly at the point the bag should release or "peel off" from the upper belt 208 and continue downwardly along carrier rods 70 along the path indicated by double-headed arrow 210.

Because this air-pumping action can be particularly effective in releasing sheets or bags from the upper belt 208, the present apparatus is particularly configured to avoid wrapping of the sheet or bag about the guide roller 205 positioned between the upstream folding mechanism 34 and the downstream folding mechanism 36. To this end, the carrier rods 70 can be provided with a nylon stripper 212 positioned in operative association with the guide roller 205. (If desired, a similar stripper can be provided in association with guide roller 207 positioned between upstream folding mechanism 36 and downstream mechanism 38). The stripper 212 desirably prevents a bag or sheet from catching on the upper ends of carrier rods 70 (or 72), and possibly deforming the rod, into any of the belts of the folding apparatus.

In order to avoid adhesion of the sheet or bag to the guide roller 205 (and the guide roller 207), it is presently preferred that a plurality of circumferentially extending grooves be provided extending about the periphery of each of the guide rollers 205, 207. In the preferred form, the grooves in the rollers 205, 207 are substantially smaller and shallower than the grooves formed in the belt 208, thus avoiding any undesirable interaction of the grooves in the belt 208 with the grooves in the rollers 205, 207. This combination of features has been found to desirably assure separation of the bag or sheet material from the upper belt 208 so that the sheet or bag passes correctly into the region along carrier rods 70.

Experience in handling lightweight sheet materials has also shown that the sheet or bag can drop slightly when crossing the gap that exists between roller 204 of folding mechanism 34, and the guide roller 205. While the bag is typically eventually caught up and continues about the roller 205, a "wave" in the bag can be created, which can again result in undesirable wrinkling of the bag. In order to prevent the bag from dropping down at this gap between the rolls 204 and 205, a vacuum applying arrangement, in the form of vacuum box 202, is provided above the perforated belt 208, with the vacuum box 202 applying vacuum to the sheet or bag through the holes in the belt 208. In a presently preferred embodiment, an additional vacuum box 203 is provided in operative association with the guide roller 207, immediately upstream thereof, thus acting through the holes in the belt 208 to hold the bag or sheet against the belt as it is moved from roller 206 about the periphery of roller 207. Because it is believed that this "dropping" of each sheet or bag as it moves onto the guide rollers 205, 207 can be a result of a lamination-like adhesion of each sheet to the lower belts 213, 214 of the folding mechanisms 34, 36, longitudinal grooving of the lower belts 213, 214, as illustrated in FIG. 7, can be desirable.

From the foregoing it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. An apparatus for folding individual sheets of material received from an associated infeed, comprising:

at least one carrier means along which each said individual sheet is carried as it is received from said associated indeed;

at least one pair of nip rollers positioned in respective operative association with each of said carrier means;

at least one pair of opposed, substantially flat belts respectively trained about said pair of nip rollers; and at least one directing means for directing an intermediate portion of each said sheet from a respective one of said carrier means between the respective pair of said nip rollers and said flat belts to effect folding of each said sheet therebetween, at least one of said flat belts including means for abating lamination-like adhesion of said sheet to said one flat belt, comprising a plurality of longitudinally extending grooves defined in a sheet-contacting surface thereof.

2. A folding apparatus in accordance with claim 1, wherein said one of said flat belts defines a plurality of holes extending therethrough to abate said lamination-like adhesion.

3. A folding apparatus in accordance with claim 2, wherein said one of said flat belts defines a plurality of transversely extending drive teeth opposite a sheet-contacting surface of said belt, at least some of said holes extending through said belt between said drive teeth.

4. A folding apparatus in accordance with claim 2, wherein said one of said flat belts defines a plurality of longitudinally extending grooves in a sheet-contacting surface thereof, said holes extending through said belt from the bottoms of said grooves.

5. An apparatus for folding individual sheets of material received from an associated infeed, comprising:

a plurality of folding mechanisms each including a carrier, a pair of nip rollers positioned in operative association with the carrier, and upper and lower flat belts respectively trained about said nip rollers, each said sheet being carried by said carrier, with an intermediate portion of each said sheet being directed therefrom between the nip rollers and the belts to effect sequential folding of each said sheet, wherein the upper belt of the folding mechanism comprises a common belt having means for abating lamination-like adhesion of said sheet to said common upper belt, comprising a plurality of longitudinally extending grooves in a sheet-contacting surface thereof, said common upper belt defining a plurality of holes therethrough extending from the bottoms of the grooves defined therein.

6. A folding apparatus in accordance with claim 5, wherein said common upper belt defines a plurality of transversely extending drive teeth opposite said sheet-contacting surface, at least some of said holes extending through said upper belt between said drive teeth.

7. A folding apparatus in accordance with claim 5, wherein said apparatus includes a guide roller positioned between upstream and downstream ones of said folding mechanisms about which said common upper belt is trained, said carrier of said downstream one of said folding mechanisms including a sheet stripper positioned in operative association with said guide roller to abate adhesion of each said sheet to said guide rollers as each sheet is carried thereabout on a sheet-contacting surface of said common upper belt.

8. A folding apparatus in accordance with claim 5, wherein said apparatus includes a guide roller positioned between upstream and downstream ones of the folding mechanisms about which said common upper belt is trained, said guide roller defining a plurality of circumferentially extending grooves at the periphery thereof to abate adhesion of each said sheet to said guide roller as each sheet is carried thereabout on a sheet-contacting surface of said common upper belt.

9. A folding apparatus in accordance with claim 5, wherein said apparatus includes a guide roller positioned between upstream and downstream ones of said folding mechanisms about which said common upper belt is trained, said apparatus further including vacuum means positioned immediately upstream of said guide roller for applying vacuum through said holes in said common upper belt to each said sheet to hold each said sheet against a sheet-contacting surface of said common upper belt as the upper belt and each sheet are guided about said guide roller.

10. An apparatus for folding sheets of material received from an associated infeed, comprising:

at least one carrier means along which each said individual sheet is carried as it is received from said associated infeed;

at least one pair of nip rollers positioned in respective operative association with each of said carrier means;

at least one pair of opposed, substantially flat belts respectively trained about said pair of nip rollers; and at least one directing means for directing an intermediate portion of each said sheet from a respective one of said carrier means between the respective pair of said nip rollers and said flat belts to effect folding of each said sheet therebetween, at least one of said flat belts including means for abating lamination-like adhesion of said sheet to said one flat belt, comprising a plurality of longitudinally extending grooves defined in a sheet-contacting surface thereof, wherein a pattern of said grooves in one of said belts differs from a pattern of said grooves in the other of said belts.

11. An apparatus for folding individual sheets of material received from an associated infeed, comprising:

at least one carrier means along which each said individual sheet is carried as it is received from said associated infeed;

at least one pair of nip rollers positioned in respective operative association with each of said carrier means;

at least one pair of opposed, substantially flat belts respectively trained about said pair of nip rollers; and at least one directing means for directing an intermediate portion of each said sheet from a respective one of said carrier means between the respective pair of said nip rollers and said flat belts to effect folding of each said sheet therebetween, at least one of said flat belts including means for abating lamination-like adhesion of said sheet to said one flat belt, comprising a plurality of longitudinally extending grooves defined in a sheet-contacting surface thereof; and at least one guide means positioned in operative association with a respective one of said carrier means, said guide means acting to prevent folding of a leading edge portion of each said sheet as it is directed from aid carrier means and is folded between the respective pair of nip rollers and pair of flat belts.

12. A folding apparatus in accordance with claim 11, wherein said guide means comprises a guide screen positioned in closely spaced relationship to said carrier means.

13. A folding apparatus in accordance with claim 12, wherein said guide means comprises a guide conveyor having a sheet-contacting surface positioned in closely spaced relationship to said carrier means, said sheet-contacting surface being driven in a direction opposite to the direction of movement of each said sheet as it is directed between the respective pair of nip rollers and pair of flat belts.

* * * * *